US005921821A

United States Patent [19]

Oka et al.

[11] Patent Number: 5,921,821

[45] Date of Patent: Jul. 13, 1999

[54] TERMINAL FITTING

[75] Inventors: Hiroyuki Oka; Naoya Kurimoto; Yoshimasa Wada; Kenji Okamura, all of Yokkaichi; Masahiro Hiratani, Tsu, all of Japan

[73] Assignee: Sumitomo Wiring Systems, Ltd., Japan

[21] Appl. No.: 08/902,576

[22] Filed: Jul. 29, 1997

[30] Foreign Application Priority Data

Aug. 8, 1996 [JP] Japan ..... 8-210244

[51] Int. Cl.[6] ..... H01R 13/187

[52] U.S. Cl. ..... 439/845; 439/745

[58] Field of Search ..... 439/842, 843, 439/845, 846, 952

[56] References Cited

U.S. PATENT DOCUMENTS

| | | | |
|---|---|---|---|
| 4,124,265 | 11/1978 | Turk . | |
| 5,100,345 | 3/1992 | Endo et al. . | |
| 5,246,390 | 9/1993 | Egenolf . | |
| 5,433,629 | 7/1995 | Yagi et al. | 439/845 |
| 5,658,174 | 8/1997 | Benes et al. | 439/842 |

FOREIGN PATENT DOCUMENTS

| | | | |
|---|---|---|---|
| 0 517 076 A2 | 9/1992 | European Pat. Off. . | |
| 0 517 077 A2 | 9/1992 | European Pat. Off. . | |
| 0 517 139 A2 | 9/1992 | European Pat. Off. . | |
| 2707431 | 1/1995 | France | 439/843 |
| 44 13 756 | 7/1995 | Germany . | |

*Primary Examiner*—Neil Abrams
*Assistant Examiner*—J. F. Duverne
*Attorney, Agent, or Firm*—Banner & Witcoff, Ltd.

[57] ABSTRACT

A protective cover B of an electrical terminal is partitioned into an upper cover 50 and a lower cover 40. By doing this, the upper cover 50 and the lower cover 40 can be simultaneously bent prior to fitting. The upper cover 50 has its left and right edges bent perpendicular downwards, the left and right side plates having supporting holes 54 formed thereon. The lower cover 40 has a pair of fitting members 41 and crimping members 42 protruding therefrom, the fitting members 41 having supporting protrusions 43,44 fitting with the supporting holes 54,15 formed on the upper cover 50 and the terminal main body A.

7 Claims, 4 Drawing Sheets

50
51
52
55
B
56
56
53
53
54
56
A
31
22
20
21
30
31
11
10
12
14
15
41
42
40
44
45
43
41

TERMINAL FITTING

TECHNICAL FIELD

The present invention relates to an electrical terminal fitting having a protective cover provided thereon.

BACKGROUND OF THE INVENTION

In a miniaturised terminal fitting, a separate protective cover made of stainless steel is provided in order to prevent a change of shape of a resilient contact due to external force or the like. For example, a female fitting shown in FIG. 7 of this specification has a protective cover 1 formed in a tubular shape, its anterior end having lances 2 formed thereon. This cover 1 is placed on the anterior end of a terminal fitting 3 and is then fixed by means of spot soldering (at the spots indicated by blackened circles in FIG. 7).

The protective cover is formed by folding over a single piece of sheet metal. Consequently, in the case where a plurality of bent portions exist, it is necessary to carry out the bending in sequence according to a specified procedure. With an increase in the number of places to be bent, there is an accompanying increase in the time required for forming the protective cover, and it becomes very difficult to increase productivity.

The present invention has been developed after taking the above problem into consideration and aims to present a terminal fitting which gives high productivity.

SUMMARY OF THE INVENTION

According to the invention there is provided a terminal fitting comprising a terminal, and a tubular protective cover attached thereto, the cover being divided along the fitting direction of the terminal into a first cover portion and a second cover portion.

Such a cover is easy to manufacture and place around the terminal. Preferably the cover portions have mutually engageable latch members, for example a barb and aperture to retain them together. One of the cover portions and the terminal may have similar latch members.

The terminal may have recessed side walls to receive side walls of one of the cover portions so as to give the side walls a flush outer surface. In this way the other cover portion can overlap both the terminal and the cover portion which has been initially attached.

The invention also comprises a method of making a protected terminal fitting comprising the steps of a) providing a terminal;

b) attaching a first longitudinally partitioned cover portion to said terminal from a first direction perpendicular to the fitting direction of the terminal; and c) attaching a second longitudinally partitioned cover portion to said terminal from a second direction opposite to said first direction;

the cover portions surrounding at least a part of the terminal in a tubular manner.

Such a method enables protected terminals to be rapidly assembled from components of relatively simple shape.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENT

Figure 1:
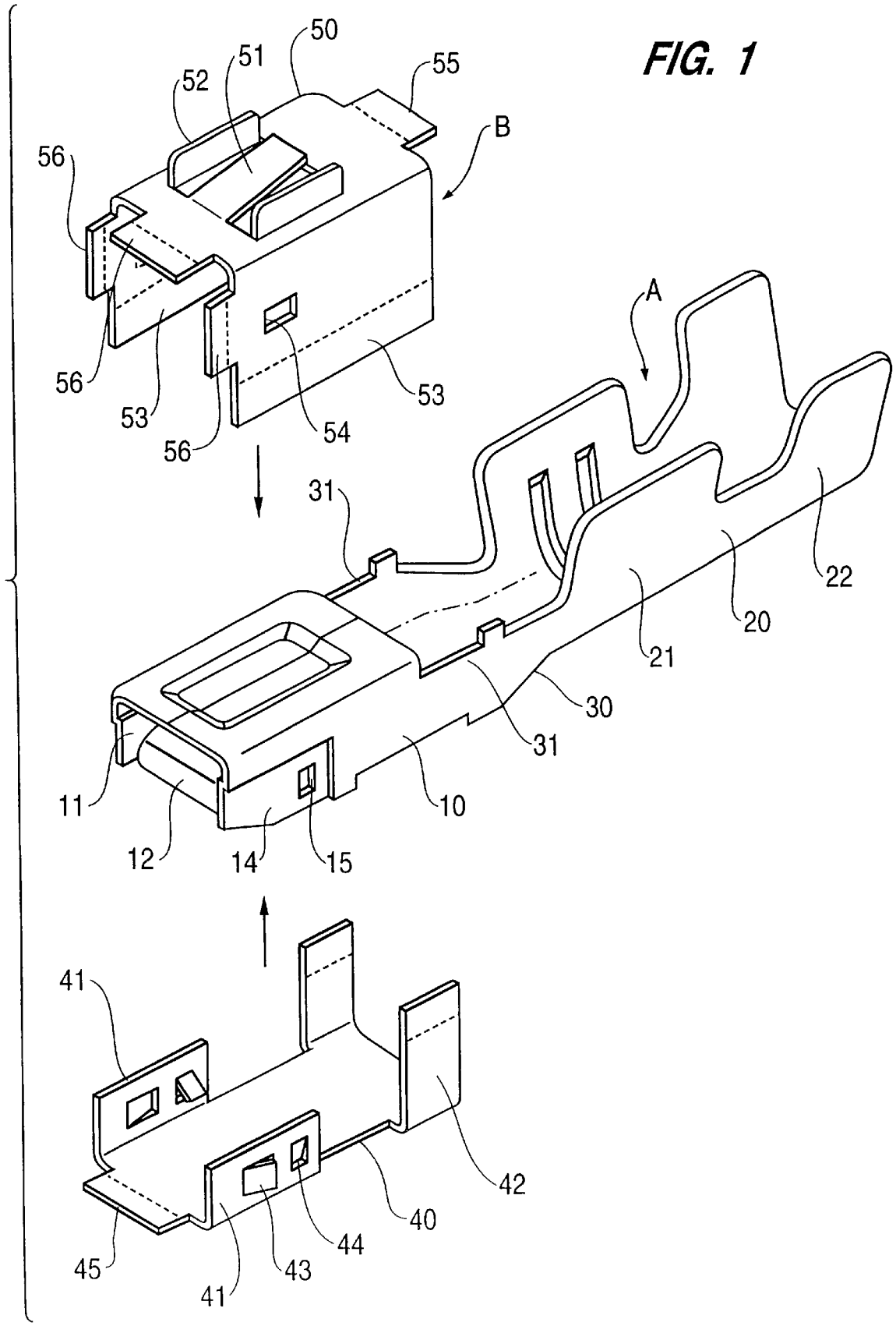
FIG. 1 is a diagonal view of a disassembled embodiment of the invention.

An embodiment of the present invention is explained hereinbelow, with reference to FIGS. 1 to 6. As shown in FIG. 1, a female terminal fitting comprises a terminal main body A and a protective cover B that covers a portion of body A.

Body A is formed by bending a thin electrically conductive metal plate (made of e.g. copper alloy) and has an insertion member 10 into which a corresponding male terminal fitting (not shown) is inserted, and a barrel member 20 connected to the insertion member 10 via a connecting member 30. The barrel member 20 comprises a wire barrel 21 that crimps the core of an electric wire, and an insulation barrel 22 on the posterior side of the wire barrel 21 that crimps a covered portion of the electric wire.

Figure 6:
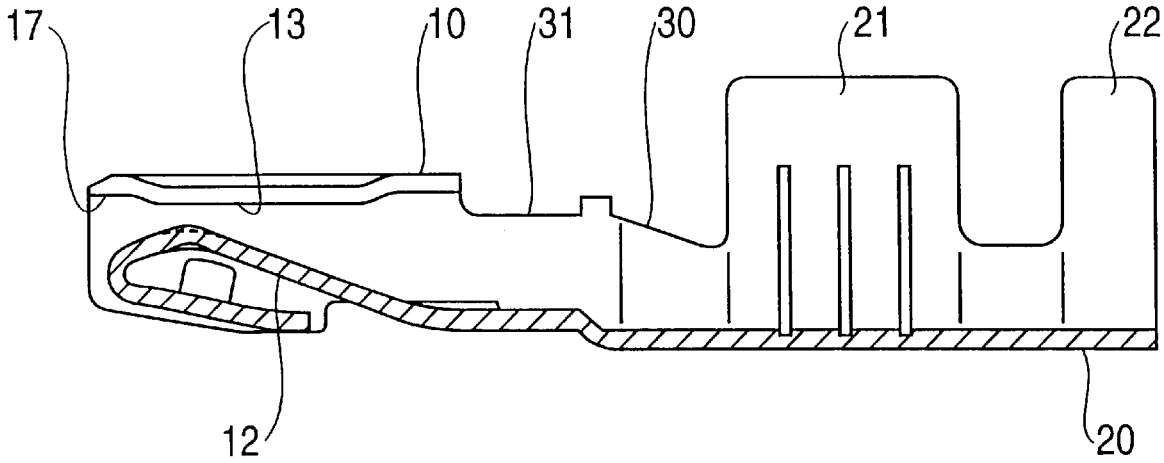
FIG. 6 is a cross-sectional view of the terminal main body.
Figure 7:
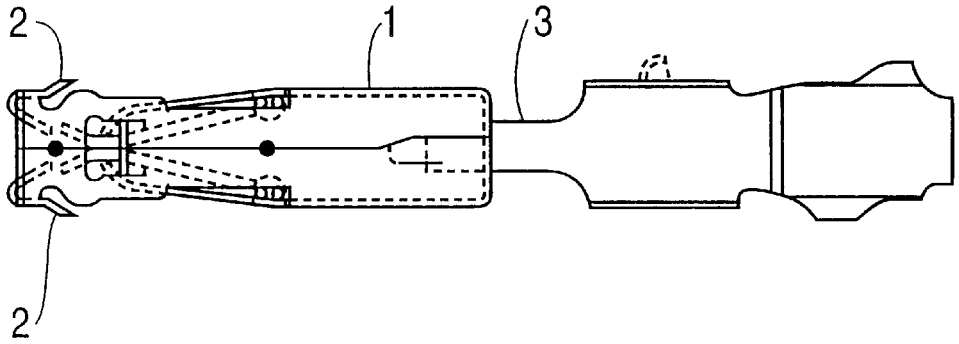
FIG. 7 (PRIOR ART)
FIG. 7 is a view from below of a prior art example.

The insertion member 10 has a box shape and its anterior end face opens out, forming an insertion hole 11 for insertion of a male terminal fitting. Furthermore, as shown in FIG. 6, a resilient contact member 12 is formed inside the insertion member 10 by shearing away from the posterior end of the base plate, the anterior end of this resilient contact member 12 folding over downwards and making contact with a lower face of the protective cover B, to be described later. Thus, a male terminal fitting inserted into the insertion member 10 bends the resilient contact member 12 downwards and makes contact therewith. The portion folded over downwards from the anterior end of the resilient contact member 12 protrudes from the base face, thereby increasing the contact pressure against the male terminal fitting.

The roof face of the insertion member 10 has a recessed member 13 that is formed by pressing-in, this recessed member 13 serving to press down on the male terminal fitting inserted into the insertion member 10, thereby making the male terminal fitting make firm contact with the resilient contact member 12.

Figure 2:
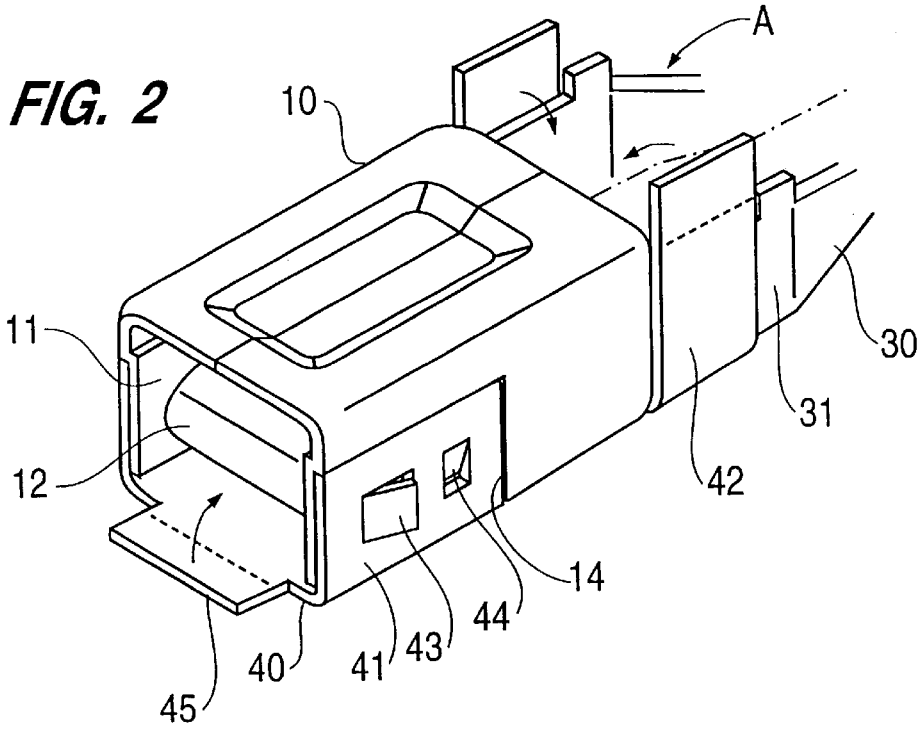
FIG. 2 is a diagonal view showing a lower cover attached to a terminal main body.
Figure 3:
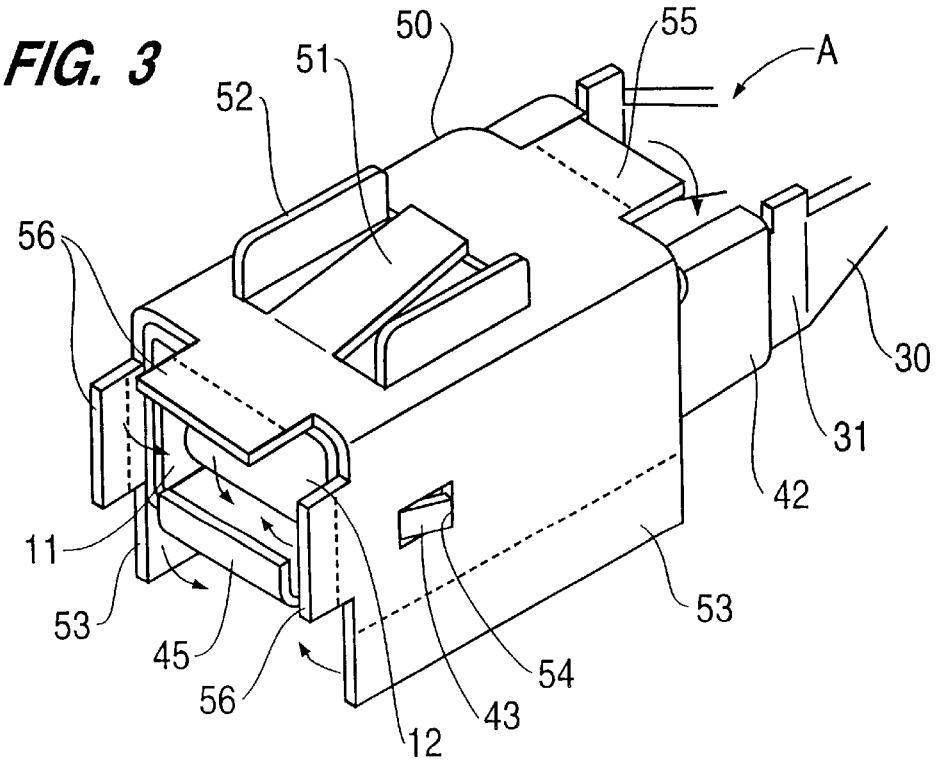
FIG. 3 is a diagonal view showing the lower cover and an upper cover attached to the terminal main body.
Figure 4:
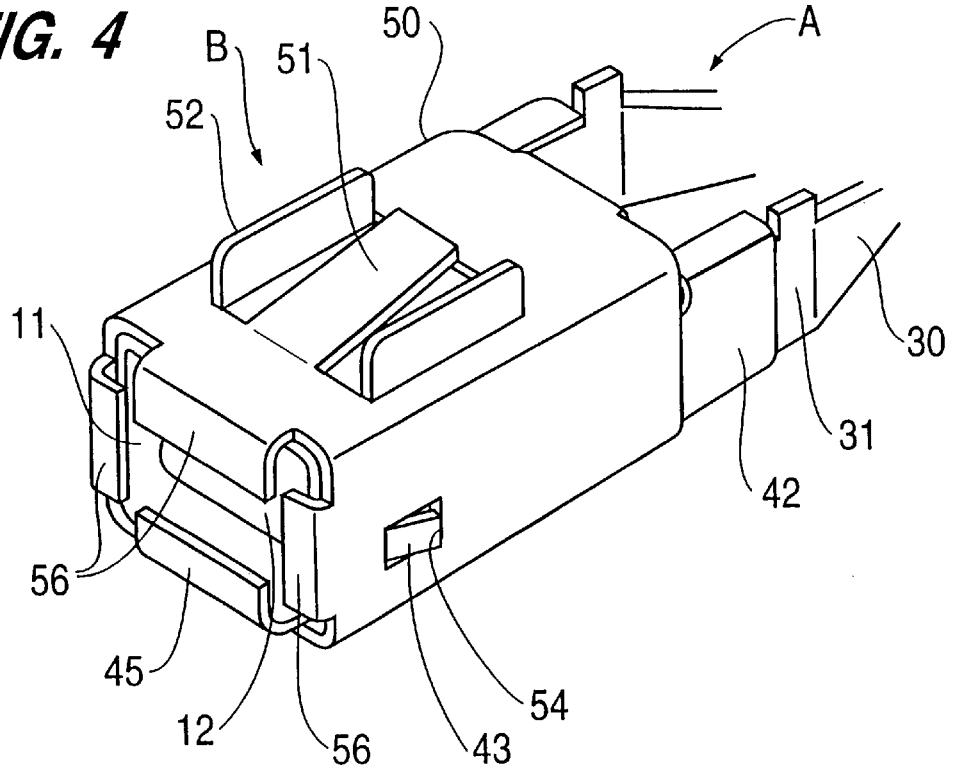
FIG. 4 is a diagonal view showing the protective cover.

The anterior portions of the left and right side walls (the more proximate and distant side walls) of the insertion member 10 are stepped inwardly, a fitting member 41 of a lower cover 40, to be described later, fitting into the stepped member 14. The depth of this stepped member 14 is set so that, in the state where the fitting member 41 is in a fitted state therewith, the fitting member 41 forms a uniform face with the left and right side faces of the insertion member 10 (FIG. 2).

Furthermore, a rectangular position fixing hole 15 is formed as a latch element at the posterior end inside the stepped member 14, a position fixing protrusion or barb 44 of the lower cover, to be described later, fitting therein as a complementary latch element.

The connecting member 30 is formed in a tapered manner from the posterior end of the insertion member 10 to the anterior end of the barrel member 20. Its left and right side walls each have a crimping and fixing member 31 for receiving a crimping member 42 of the lower cover 30, to be described later.

The protective cover 8 is made from stainless steel into a box-shape and is partitioned into an upper cover 50 and a lower cover 40, this partition being effected in the lengthwise direction of the main body A.

The upper cover 50 is formed by bending left and right end portions (in FIG. 1, the ends extending in the lengthwise direction) in an approximately perpendicular downward direction. A roof plate of the upper cover 50 has a lance 51 formed by shearing away diagonally from the anterior end (the more proximate side in the figure). Further, the left and right sides of the lance 51 have protective walls 52 cut-out so as to be approximately perpendicular with respect to the lance 51. These serve to prevent the entry of foreign matter into the space under the lance 51 and also to prevent change of shape of the lance 51 due to an external force being applied thereto.

Figure 5:
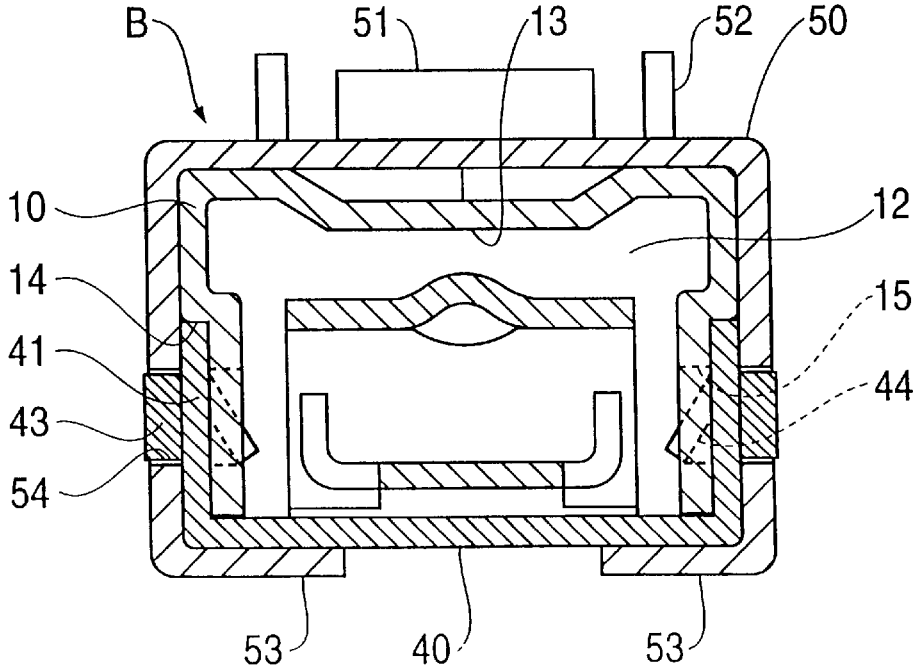
FIG. 5 is a cross-sectional view showing the protective cover attached to the terminal main body.

The left and right sides of the upper cover 50 extend downwards beyond the height of the insertion member 10. As shown in FIG. 5, lower end members 53 thereof are bendable inwards so as to surround the base plate of the lower cover 40 in the state where the upper cover 50 and the lower cover 40 are fitted together. Further, the left and right sides of the upper cover 50 have rectangular supporting holes 54 as latch element located towards an anterior end, a supporting protrusion or barb 43 of the lower cover 40 (to be described later) fitting therein.

The roof plate of the upper cover 50 has a removal preventing member 55 formed on its posterior edge. In the state where it is attached to the terminal main body A, this bends downwards and fits with the posterior edge of the insertion member 10, thereby preventing removal of the protective cover B in the anterior direction. Further, the anterior edges of the roof plate and the left and right sides of the upper cover 50 have bendable guiding members 56 formed thereon. In the attached state with respect to the terminal main body A, these are bent inwards, thereby defining the insertion hole 11 of the insertion member 10 and ensuring the insertion of the main terminal fitting to the correct position.

The lower cover 40 forms the base plate of the protective cover 8 when it is in an attached state with respect to the upper cover 50. The left and right edges of this base plate (in FIG. 1, the edges extending along the lengthwise direction) have a pair of fitting members 41 formed at the anterior end so as to be bent upwards approximately perpendicularly. These fitting members 41 each have a supporting protrusion 43 formed as a latch element at the anterior end, and a position fixing protrusion 44 formed as a latch element at the posterior end, these being formed by part shearing. The supporting protrusion 43 is cut out so as to protrude outwards in a diagonal manner from the anterior end and fits into the supporting hole 54 of the upper cover 50, so as to hold the upper cover 50 and the lower cover 40 together.

The position fixing protrusion 44 is formed so as to be cut away diagonally inwards from the upper end, and fits with the position fixing hole 15 of the insertion member 10, so as to retain the protective cover B with the terminal main body A.

The left and right edges of the lower cover 40 have a pair of crimping members 42 formed on the posterior edges thereof, these crimping members 42 bending upwards. When the lower cover 40 is in an attached state with respect to the terminal main body A, these overlap with the exterior of the crimping and fixing members 31 of the connecting member 30. The lower cover 40 is crimped and fixed to the terminal main body A. The anterior edge of the base plate of the lower cover 40 has a protruding bendable protecting member 45. When the lower cover 40 is in an attached state with respect to the terminal main body A, it is bent inwards, thereby covering the lower portion of the insertion hole 11 and preventing the male terminal fitting from colliding against the resilient terminal fitting 12.

The assembly sequence of the female terminal fitting is as follows. First, the lower cover 40 is attached from below to the insertion member 10 and the fitting member 41 of the lower cover 40 is inserted into stepped member 14 of the insertion member 10. In this manner, the position fixing protrusion 44 fits into the position fixing hole 15 and the lower cover 40 is fixed in position with respect to the terminal main body A, the crimping member 42 reaching a state whereby it overlaps with the exterior of the crimping and fixing member 31 of the connecting member 30 (see FIG. 2). Then, the protecting member 45 is bent inwards.

Next, the upper cover 50 is placed onto the insertion member 10 from above. When this is done, the supporting protrusion 43 of the lower cover 40 enters the supporting hole 54, and the upper cover 50 and the lower cover 40 are supported in an assembled state (see FIG. 5). Moreover, from this state, the lower end members 53 of the left and right side plates are bent inwards and the base plate is surrounded; the removal of the upper cover 50 in an upwards direction is prevented (see FIG. 5). Furthermore, once the removal preventing member 55 and the guiding member 56 are bent inwards, the attachment of the protective cover B with respect to the terminal main body A is complete and, accordingly, the female terminal fitting is completed.

The embodiment achieves the following effects by means of the configuration described.

(1) Since the protective cover B is partitioned the upper cover 50 and the lower cover 40 can be bent by means of separate processes. Consequently, since the upper cover 50 and the lower cover 40 can be formed simultaneously, even in the case where the bending has to be carried out at a plurality of locations, productivity can be increased.

(2) In order to attach the protective cover B to the terminal main body A, the upper cover 50 and the lower cover 40 are simple assembled so as to clamp the terminal main body A. Compared to the conventional case, during assembly there is a smaller likelihood of occurrence of damage to or change of shape in the terminal main body A due to contact between the protective cover B and the terminal main body A.

(3) Since in order to support the partitioned upper cover 50 and the lower cover 40 in their assembled state only the supporting protrusion 43 and the supporting hole 54 need to be fitted together, there is no need for soldering etc. Accordingly, not only can operability be improved, but equipment-related costs can also be reduced.

(4) By fitting together the position fixing protrusion 44 and the position fixing hole 15, the position of the lower cover 40 with respect to the terminal main body A can be fixed, and, as a result, the protective cover B can be attached with certainty in a specified position.

(5) By partitioning the protective cover B, upper cover 50 and lower cover 40 can be of simple form, thereby making a complicated single configuration unnecessary.

The present invention is not limited to the embodiment described above with the aid of figures. For example, the possibilities described below also lie within the technical range of the present invention.

(1) In the above embodiment, although a case was described where the invention applies to a female terminal fitting, the present invention may equally be applied to a male terminal fitting.

(2) In the above embodiment, although a case was described where the supporting protrusion 43 and the supporting hole 54 fit mutually in order to support the upper cover 50 and the lower cover 40 in their attached state, it may equally be arranged so that the upper cover and the lower cover are supported in an attached state by means of spot soldering.

(3) In the above embodiment, although the position fixing protrusion 44 formed on the lower cover 40 fits with the position fixing hole 15 formed on the terminal main body A, it may equally be arranged so that the position fixing protrusion is provided on the upper cover. Furthermore, it may equally be arranged so that the position fixing protrusion and the position fixing hole are not provided.

(4) In the above embodiment, the supporting hole 54 is formed on the upper cover 50, and the lower cover 40 has the supporting protrusion 43 that can fit therein. It may equally be arranged so that, conversely, the protrusion is formed on the upper cover and the hole that fits with this is formed in the lower cover.

(5) In the above embodiment, the position fixing hole 15 is formed on the terminal main body A, and the position fixing protrusion 44 that fixes therewith is formed on the lower cover 40. However, it may equally be arranged so that, conversely, the protrusion is formed on the terminal main body A and the hole that fits with this is formed in the lower cover 40.

(6) In the above embodiment, although the protective cover B is partitioned into an upper and lower partition, it may equally be arranged so that it is partitioned into left and right sides. In addition, the present invention may be embodied in various other ways without deviating from the scope thereof.

We claim:

1. A terminal fitting comprising a terminal formed of bent sheet metal to have a connecting portion for coupling with a complementary terminal and a barrel portion for attaching to a wire, and a tubular protective cover attached to said terminal, the cover being formed of metal and divided along the fitting direction of the terminal into two separate parts including a first cover member and a second cover member, each said cover member including a latch element which couples to the latch element of the other cover member to retain the cover about a portion of the terminal.

2. A terminal fitting according to claim 1 wherein said latch element of one of the cover members comprises an aperture, and said latch element of the other of the cover members comprises a barb.

3. A terminal fitting according to claim 1 wherein said terminal and one of said cover members have mutually engageable terminal latch elements to retain said terminal and said cover together.

4. A terminal fitting according to claim 3 wherein said terminal latch element of said terminal or said one cover member comprises an aperture, and the terminal latch element of the other of said terminal or said one cover member comprises a barb.

5. A terminal fitting according to claim 1 wherein said terminal and said cover members each have opposed side walls, each of said terminal side walls has an inward step to define an inner surface and an outer surface, said steps receive the side walls of one of said cover members so that an outer face of each received side wall is generally flush with the respective outer surface of the terminal at said step.

6. A terminal fitting according to claim 1 wherein one of said cover members overlaps the other cover member.

7. A terminal fitting according to claim 1 wherein one of the cover members includes a lance adapted to hold the terminal in a connector housing.

* * * * *